United States Patent [19]

Ono et al.

[11] Patent Number: 4,519,427

[45] Date of Patent: May 28, 1985

[54] DEVICE FOR RECOVERING CONTENTS IN CONTAINERS SUCH AS BEER BOTTLES

[75] Inventors: Motoji Ono; Masao Hirao; Shigehisa Fukushima, all of Okayama, Japan

[73] Assignee: Kirin Beer Kabushiki Kaisha, Tokyo, Japan

[21] Appl. No.: 504,295

[22] Filed: Jun. 14, 1983

[51] Int. Cl.[3] ..... B65B 3/04

[52] U.S. Cl. ..... 141/65; 141/115; 222/400.7; 406/142

[58] Field of Search ..... 141/1-12, 141/37-69, 129-192, 250-284, 367-386, 392, 70, 115-128, 85-93; 222/400.7, 399; 406/142

[56] References Cited

U.S. PATENT DOCUMENTS 3,913,802 10/1975 Ianni ..... 222/400.7

*Primary Examiner*—Houston S. Bell, Jr.
*Attorney, Agent, or Firm*—Ladas & Parry

[57] ABSTRACT

A device for recovering or discharging the contents in containers such as beer bottles or the like includes a case support adapted to horizontally support at least one case containing a predetermined number of containers; a plurality of recovery pipes provided vertically above the case support, each of the plurality of recovery pipes being in opposed relation with the opening of each of the containers in the case; a control valve for controlling the charging of compressed air into the containers in the case; an air supply source for supplying the compressed air which is charged through the control valve; and a recovery tank communicating with the plurality of recovery pipes storing therein the liquid which is forced to be discharged out of the containers in the case through the recovery pipes, the case support and the plurality of recovery pipes being movable toward or away from each other so that when they are moved toward each other the recovery pipes are inserted into the openings, respectively, of the containers in the case by a predetermined distance, the control valve being so actuated when the recovery pipes are inserted into the containers in the case by a predetermined distance that the air supply source communicates with the containers in the case, thereby discharging the contents or the liquid within the container out of the containers through the recovery pipes and into the recovery tank.

7 Claims, 8 Drawing Figures

DEVICE FOR RECOVERING CONTENTS IN CONTAINERS SUCH AS BEER BOTTLES

BACKGROUND OF THE INVENTION

The present invention relates to a device for recovering the contents in containers such as beer bottles.

In general automatic bottle-filling machines are used to put liquors such as beer, sake and the like, soft drinks such as juice and liquid condiments into bottles, but sometimes the quantity of filled liquid varies from one bottle to another. It is of course not preferable that the quantity of filled liquid is less or greater than a predetermined quantity. Therefore, devices for recovering the contents of over-filled bottles have been used in order to automatically recover the over-filled liquid.

A device for recovering the over-filled liquid which the inventors have used has the following construction. A cylindrical frame is horizontally disposed so as to be rotatable about its axis. The cylindrical frame has a supporting plate adapted to support a case containing a plurality of bottles and a liquid discharge chute disposed in opposed relationship with the case supporting plate. In general, the liquid discharge chute is in the form of a funnel and is adapted to engage with the opening of a bottle case supported on the supporting plate when an air cylinder which is mounted on the cylindrical frame is actuated. The larger closed end of the liquid discharge chute which releasably engages with the opening of the bottle case is formed with a plurality of holes through which the necks of the bottles in the case are extended. When the air cylinder is further actuated so that the larger closed end of the liquid discharge chute is engaged with the opening of the bottle case, the necks of the bottles enter the holes and the shoulders of the bottles abut against the edges of the holes, whereby the bottles are held stationary.

After the bottles are retained in position in the manner described above, the cylindrical frame is rotated through 100° to 180° to turn the bottle case upside down so that the contents in the bottles are discharged by gravity and the discharged liquid is directed through the liquid discharge chute into a reservoir or recovery tank disposed immediately below the cylindrical frame.

However, the device of the type described above has some problems. Firstly, since the cylindrical frame is rotated to turn the cases upside down, dust particles and water drops attached to the surfaces of cases and bottles are separated therefrom and mixed with the recovered liquid. Furthermore in the case of carbonated beverages and soft drinks, much foam is generated thereby to lose a considerably large quantity of recovered liquid.

In addition to the device of the type described above, the following device is used. That is, this device is similar in construction to a bottle opening machine and in general is assembled in combination with a bottle opening machine. This device comprises a rotary disk or turntable with a plurality of bottle supporting members circumferentially equiangularly spaced apart from each other. The piston rod of a lift cylinder is securely attached to the undersurface of the bottle supporting member so that the bottle supporting member may be lifted away from the turntable or rotary disk to a predetermined height. Disposed immediately above the turntable or rotary disk is a liquid draining device adapted to rotate in synchronism with the turntable or rotary disk. A plurality of liquid draining tubes or pipes equal in number to the bottle supporting members are depending from the liquid draining device in opposed relationship with the bottle supporting members and are communicated with a sunction pump which in turn is communicated with a reservoir or recovery tank. The liquid draining pipes are adapted to be inserted into the bottles. A bell-shaped guide member is slidably fitted on each of the liquid draining pipes and is adapted to fit over the neck portion of the bottle so that the liquid draining pipe may be smoothly inserted into the bottle.

The bottles whose contents are less or greater than a predetermined quantity are arranged in a straight array on a conveyor and transferred by a star wheel over the bottle supporting members one by one. When a bottle is placed on a bottle supporting member, the lift cylinder is actuated so that the bottle is lifted and its mouth or opening is engaged with the bell-shaped guide member of the liquid draining pipe. When the bottle is further lifted, the liquid draining pipe is inserted into the bottle while the bell-shaped guide member is lifted along the liquid draining pipe. When the lower end of the liquid draining pipe reaches a position spaced apart from the bottom of the bottle by a small distance, the bell-shaped guide member strikes against a stopper securely fixed to the liquid draining pipe so that the latter is lifted and consequently a control valve which is provided between the suction pump and the liquid draining pipe is opened. Therefore the liquid in the bottle is drained or suctioned to flow through the liquid draining pipe, the control valve and the suction pump into the reservoir or recovery tank.

After the content in the bottle has been completely drained, the lift cylinder is actuated again to lower the bottle supporting member and the emply bottle is transferred to a discharge conveyor disposed adjacent to the rotary disk or turntable so as to be transported to the next station.

The device of the type described above also has some disadvantages. Firstly, the bottles must be taken out of the cases and put on the conveyor and after the bottles have been emptied, they must be packed into the cases again. In order to automate such operations as described above, additional equipment such as an uncaser for taking the bottles from the cases and a caser for putting the emptied bottles into the cases must be provided, so that the overall liquid recovery system becomes large in size and complex in construction. Furthermore a large installation space will be needed.

SUMMARY OF THE INVENTION

It is an object of this invention to provide a device for recovering the contents in containers such as beer bottles which can minimize the contamination and foaming of the recovered liquid, whereby the liquid recovery efficiency can be remarkably improved. A further object of the present invention is to provide a device for recovering the contents in containers such as beer bottles without turning upside down a case containing a plurality of bottles.

According to the present invention, there is provided a device for recovering the contents in containers such as beer bottles, comprising a case supporting means adapted to horizontally support at least one case containing a predetermined number of containers; a plurality of recovery pipes provided vertically above said case supporting means, each of said plurality of recovery pipes being in opposed relationship with the opening of each of said containers in said case; control valve means for controlling the charging of the compressed air into said containers in said case; an air supply source for supplying the compressed air which is charged through said control valve means into said containers in said case; and a recovery tank communicated with said plurality of recovery pipes for storing therein the liquid which is forced to be discharged out of said containers in said case through said recovery pipes, said case supporting means and said plurality of recovery pipes being movable toward or away from each other so that when they are moved toward each other said recovery pipes are inserted into the openings, respectively, of said containers in said case by a predetermined distance, said control valve means being so actuated when said recovery pipes are inserted into said containers in said case by a predetermined distance that said air supply source is communicated with said containers in said case, whereby the contents or liquid in said containers in said case are discharged out of said containers in said case through said recovery pipes into said recovery tank.

The above and other objects, effects and features of the present invention will become more apparent from the description of a preferred embodiment thereof taken in conjunction with the accompanying drawings.

DETAILED DESCRIPTION OF THE INVENTION

Figure 1:
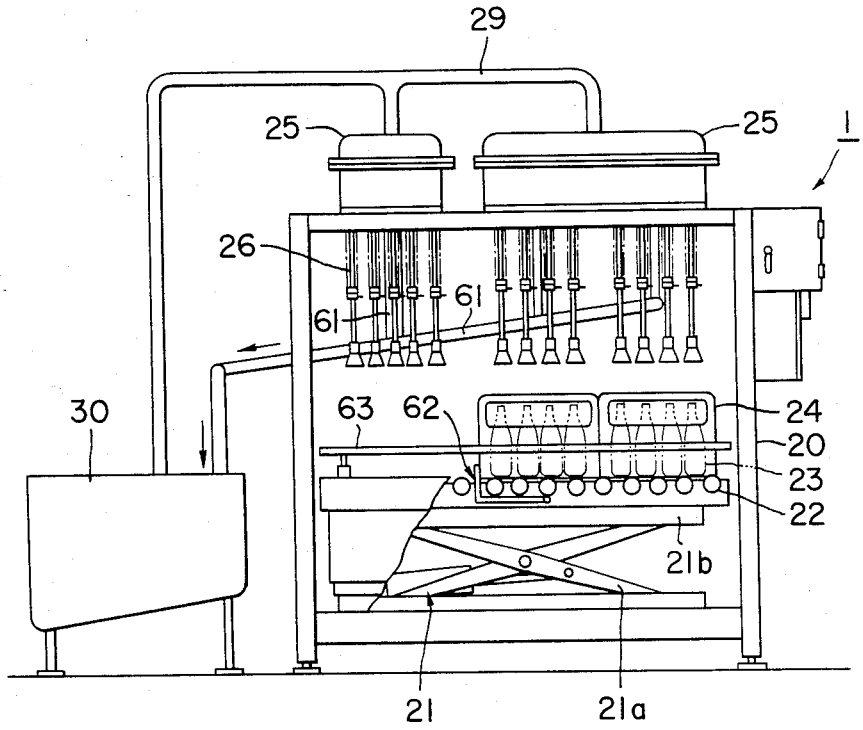
FIG. 1 is a front view of a preferred embodiment of a device for recovering the contents in containers such as beer bottles in accordance with the present invention.
Figure 2:
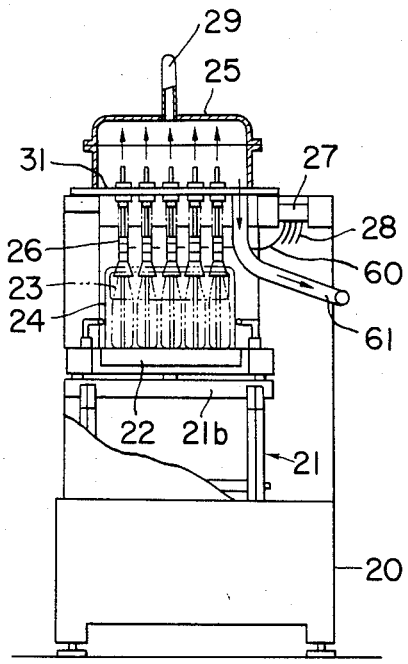
FIG. 2 is a side view thereof.

In FIGS. 1 and 2 is shown one preferred embodiment of a device for recovering liquid from containers such as beer bottles in accordance with the present invention. Liquid recovery device generally indicated by the reference numeral 1 has a frame 20 and a hydraulically operated lifter 21 is disposed at the lower portion of the frame 20. The lifter 21 comprises crossed arms 21*a* and a supporting plate 21*b* supported by the crossed arms 21*a*. A free roller conveyor 22 is mounted on the supporting plate 21*b* of the lifter 21 and includes guide means (not shown) for guiding and positioning bottle cases and stoppers 62. Cases 24 each containing a plurality of bottles 23 are placed on the conveyor 22. The supporting plate 21*b* is provided with a guard rail 63 in order to prevent the cases 24 from falling from the supporting plate 21*b*. Recovery tanks 25 are mounted on the top of the frame 20 so as to temporarily store the liquid recovered from the bottles 23. For instance, the recovery tanks 25 are divided into two types. One type is for storing the liquid recovered from small bottles (that is, 30 small bottles are contained in each case 24) and the other is for storing the liquid from large and medium-sized bottles (that is, 20 large- or medium-sized bottles are contained in each case 24). A plurality of control valves 26 are extended downwardly from the bottom plate of each recovery tank 25 and are so arrayed that they can cooperate with the bottles 23, respectively, in each case 24. An air tank or air supply source 27 is disposed behind the recovery tank 25 and a plurality of orifice type air nozzles 28 equal in number to the control valves 26 are extended from the air tank 27. Each of the air nozzles 28 is communicated with an adapter air nozzle 43 through a vinyl tube 60 (see FIG. 3). The recovery tanks 25 are communicated through an air drain pipe 29 with a reservoir 30 so that the recovery tanks 25 may be prevented from being pressurized. The liquid recovered into the recovery tanks 25 is returned by gravity to the reservoir 30 through discharge pipes 61, 61.

Figure 3:
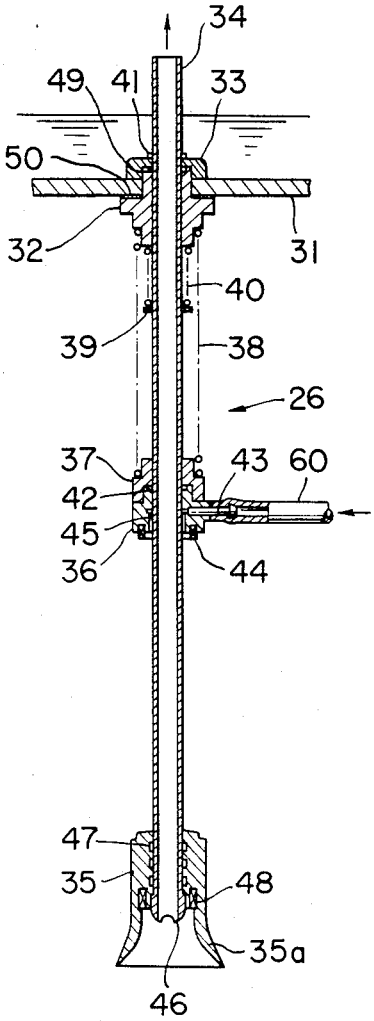
FIG. 3 is a longitudinal or axial sectional view of a control valve thereof.

In FIG. 3 is shown in detail the construction of the control valve 26. A supporting member 32 is inserted into a hole formed through a bottom plate 31 of the recovery tank 25 and is threadably engaged with a nut 33, whereby the supporting member 32 is securely attached to the bottom plate 31. That is, the bottom plate 31 is sandwiched between the supporting member 32 and the nut 33. A first valve member 36, an adapter holder 37 and compression spring 38 are mounted on the liquid recovery pipe 34 and the upper end of the liquid recovery pipe 34 is extended through the supporting member 32 and the nut 33 into the recovery tank 25. The liquid recovery pipe 34 is normally biased downwardly under the force of a compression spring 40 loaded between the supporting member 32 and a spring retainer 39, but the downward stroke of the liquid recovery pipe 34 is limited by the engagement of an O-ring 41 fitted over the upper end portion of the liquid recovery pipe 34 within the recovery tank 25 with the nut 33. Both the supporting member 32 and the adapter holder 37 are respectively provided with grooves in the form of a spiral and the upper and lower ends of the compression spring 38 are engaged with the grooves, respectively. The first valve member 36 and the adapter holder 37 are engaged with each other through an O-ring 42 and the first valve member 36 is provided with the air nozzle 43 which is communicated through the vinyl tube 60 with the air nozzle 28 of the air tank 27 as described above. The lower end of the first valve member 36 is provided with a packing 44 and the first valve member 36 has an air passage 45 which is substantially coaxial with the liquid recovery pipe 34.

A bell-shaped second valve member 35 is slidably fitted over the lower end portion of a liquid recovery pipe 34 through which the liquid in the bottle 23 may be returned or recovered in the recovery tank 25. The lower end of the liquid recovery pipe 34 is provided with a plastic tip 46 which in turn supports the bell-shaped second valve member 35 at the lower end of the pipe 34. The lower end of the cylindrical surface of the tip 46 is formed with a semicircular opening. The inner cylindrical surface of the bell-shaped second valve member 35 is formed with a helical air passage 47 (which may be, for instance, three turns of a rectangular screw thread). The bell-shaped second valve member 35 is fitted with a packing 48. Furthermore, an O-ring 49 is interposed between the supporting member 32 and the liquid recovery pipe 34 and another O-ring 50 is interposed between the bottom plate 31 of the recovery tank 25 and the supporting member 32, whereby the recovery tank 25 is liquid-tightly sealed. It should be noted that the upper end of the liquid recovery pipe 34 is extended upward above the liquid level in the liquid recovery tank 25.

Figures 4, 5, 6, 7, 8:
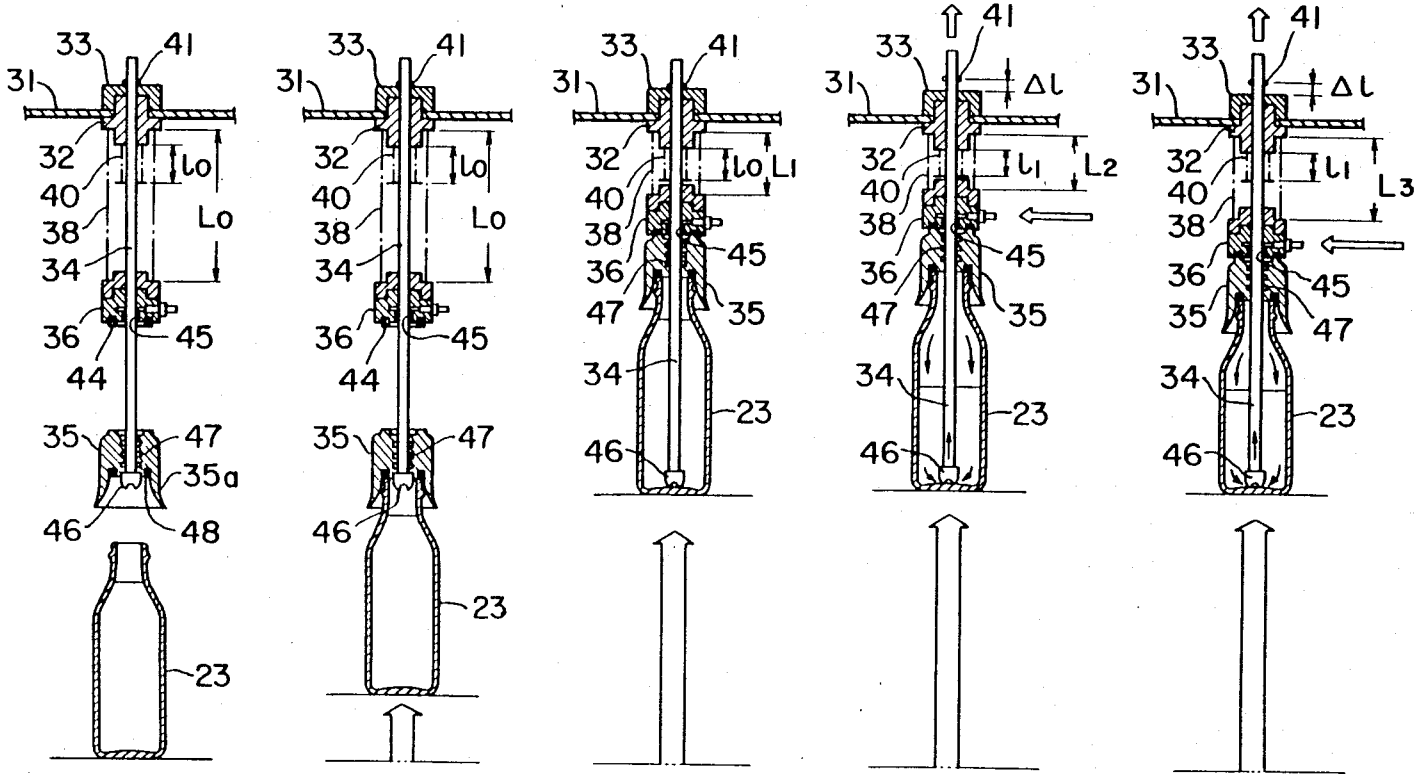
FIGS. 4–8 are views used to explain the mode of operation thereof.

Next, the mode of operation of the preferred embodiment with the above described construction will be explained. Each case 24 containing opened bottles 23 is guided on the conveyor 22 and stopped by the stoppers (not shown) so that each bottle 23 is retained in position with respect to the control valve 26 as shown in FIG. 4. Thereafter, the hydraulically operated lifter 21 is actuated so that the conveyor 22 is raised and consequently the bottle 23 is also raised together with the case 24. As a result the neck of the bottle 23 is aligned with the liquid recovery pipe 34 by the diverging skirt portion 35*a* of the bell-shaped second valve member 35 of the liquid recovery pipe 34 as shown in FIG. 5 so that the liquid recovery pipe 34 is inserted into the opening of the bottle. When the hydraulically operated lifter 21 is further raised, the tip at the lower end of the liquid recovery pipe 34 is engaged with the bottom of the bottle 23 as shown in FIG. 6 while the liquid recovery pipe 34 is caused to slide upwardly and project into the tank 25 by a distance $\Delta 1$, for example, about ten millimeters (mm) (see FIG. 7. Under these conditions, the lifter 21 is stopped so that the lift of the bottle 23 is also stopped. During these steps, the compression spring 38 is compressed from its original length $L_0$ to $L_1$ and to $L_2$ while the compression spring 40 is also compressed from its original length $l_0$ to $l_1$. Because of the compression of the compression spring 38 as a result of the lift of the bottle 23, the first valve member 36 and the bell-shaped second valve member 35 are pressed against the opening of the bottle 23 and the first valve member 36 and the bell-shaped second valve member 35 are airtightly connected to each other through the packing 44. Under these conditions, a solenoid-operated or electromagnetic valve (not shown) for supplying air is energized so that the compressed air of about 3 kg/cm$^2$G is charged into the air tank 27. The compressed air from the air tank 27 is reduced by the orifice type air nozzle 28 to about 0.5 kg/cm$^2$G and flows into the bottle 23 through the vinyl tube 61, the air nozzle 43 of the liquid recovery pipe 34, the air passage 45 in the first valve member 36 and the air passage 47 of the bell-shaped second valve member 35. As a result the compressed air charged into the bottle 23 exerts the force on the surface of the liquid in it so that the liquid in the bottle 23 is forced to flow through the semicircular opening of the tip 46 into the liquid recovery pipe 34 and finally into the recovery tank 25. Since the recovery tank 25 is communicated with the air drain pipe 29, the recovery tank 25 is not pressurized as described before so that the liquid in the bottle 23 can be smoothly recovered into the recovery tank 25. The liquid recovered in the recovery tank 25 then flows through the discharge pipe 61 into the reservoir 30. Thus the liquid in the bottles 23 is all recovered. Thereafter the hydraulically operated lifter 21 is lowered to its original position and the case 24 now containing emptied bottles 23 is transported by the conveyor 22. The feed and discharge of the cases 24 into and out of the device 1 may be manually or automatically effected.

Next some special cases will be described. First a case in which the contents of some of bottles 23 of one case 24 are extremely less than those of the remaining bottles will be described. In this case, the bottles with small contents are emptied first so that large quantities of air flow into the control valves 26 connected to these bottles 23 with small contents. As a result, the pressure of the air charged into other control valves 26 corresponding to the remaining bottles is reduced. Accordingly, the liquid in those bottles may not be returned to the recovery tank 25. However, in this invention, such a possibility can be avoided because air of 0.5 kg/cm$^2$G is supplied into each bottle 23 at any time by means of air nozzles 28. As described above, the pressure of the air charged into each bottle 23 is preferably 0.5 kg/cm$^2$G. If the pressure becomes higher, the recovered liquid is forced to impinge against the top of the recovery tank to cause intensive foaming of the recovered liquid. On the other hand, when the air pressure is too low, the period of time for emptying all the bottles 23 will become longer. Thus, as described before, in order to supply the compressed air of 0.5 kg/cm$^2$G to each bottle 23 at any time, a plurality of orifice type air nozzles 28 are provided with the air tank 27 whereby the internal pressure in the air tank 27 may rise as high as 3 kg/cm$^2$G. As the internal pressure in the air tank 27 is high enough in this way, enough air can be fed into each bottle through the nozzles 28 at any time.

If, instead of the above-described pressure application system, a vacuum suction system is employed; that is, if the liquid in the bottles 23 is suctioned by a vacuum pump, the vacuum suction system becomes large in size, but according to the present invention, the orifice type air nozzles are used so that the problems countered in the vacuum suction system can be avoided.

A second special case is such that foreign matter is interposed between the bottom of the case and the bottoms of the bottles contained in the case. In this case if the liquid recovery pipe 34 is securely fixed to the bottom plate 31 of the recovery tank 25, the lower end of the liquid recovery pipe 34 strikes against the bottom of the bottle and is consequently damaged. In order to solve this problem, it may be proposed to space the lower end of the liquid recovery pipe 34 apart from the bottom of the bottle by a sufficient distance. Then it would become impossible to completely empty the bottle. However, according to the present invention, the liquid recovery pipe 34 is slidable vertically by a distance $\Delta 1$ so as to be projected into the tank 25.

When the lower end of the pipe 34 abuts against the bottom of the bottle, the content in the bottle flows into the pipe 34 through the opening of the chip 46. Thus, the opening of the chip 46 keeps the flow of the content of the bottle at that time.

A third case is such that one case contains a plurality of bottles with different heights. For instance, in the case of the beer bottles, the large-sized beer bottles and medium-sized beer bottles are arranged in a substantially similar pattern in cases, but their heights are different. It is of course preferable that the contents in any type of beer bottles can be recovered without replacing one type of liquid control valves by other types of liquid control valves in order that the liquid recovery operation can be accomplished within a short period of time. Therefore according to the present invention, the compression spring 38 is fitted along the control valve 26 above the first valve member 36 so that the bottle 23 and the bell-shaped second valve member 35 are brought into intimate contact with each other while the bell-shaped second valve member 35 and the first valve member 36 are brought also into intimate contact with each other so that each bottle may be completely sealed and charged with the compressed air. Furthermore, a relatively longer compression spring 38 is employed so that, as shown in FIG. 8, the compressed length $L_3$ of the compression spring 38 in the case of medium-sized beer bottles can be longer than the compressed length $L_2$ in the case of large-sized beer bottles. Thus, the difference in height of bottles may be compensated for.

According to the present invention, the contents in all the bottles in each case can be simultaneously recovered. Furthermore, the cases are not turned upside down. This is very advantageous from the microbiological view point. Moreover, even when the contents in the bottles are very little or some bottles are empty or the bottoms of the bottles are not in coplanar relationship because of foreign matter interposed between the bottoms of the case and the bottle, the contents of all bottles can be simultaneously recovered. Furthermore, in such a case the quantities of liquid still remaining in the bottles are very few. If the pattern of arrangement of bottles in each case remains same, the contents of the bottles can be recovered without exchanging the liquid control valves even when the bottles are different in height. Moreover, if the number of control valves is increased, the contents of bottles in a plurality of cases can be simultaneously recovered.

Next, the results of experiments conducted by the inventors will be described. When the air at the pressure of 0.5 $kg/cm^2G$ was charged into a large-sized beer bottle (with the volume or content of 633 ml), it took only 7 or 8 seconds to empty the bottle. In this case, the internal pressure of the air tank was about 3 $kg/cm^2G$. In the cases of large- or medium-sized beer bottles, 4 or 5 cases can be disposed per minute. The remaining quantity in each bottle was about 5 ml at that time. In the case of small-sized beer bottles, the remaining beer was negligible. Increase in contamination due to microbes was also negligible.

As described above, according to the present invention, the contents in bottles contained in cases can be simultaneously recovered leaving only a small or negligible quantity of liquid. Moreover, the cases are not turned upside down. Accordingly, the number of microbes in the recovered liquid is considerably reduced and splash of recovered liquid can be avoided.

What is claimed is:

1. A device for recovering the contents in containers such as beer bottles, comprising:

a case supporting means supporting at least one case containing a predetermined number of containers and movable upward and downward;

a plurality of recovery pipes provided vertically above said case supporting means, each of said plurality of recovery pipes being in opposed relationship with the opening of each of said containers in said case;

control valve means for controlling the charging of the compressed air into said containers in said case;

an air supply source for supplying the compressed air which is charged through said control valve means into said containers in said case; and a recovery tank communicating with said plurality of recovery pipes for storing therein the liquid which is forced to be discharged out of said containers in said case through said recovery pipes, each of said control valve means comprising a first valve member which is slidably fitted on a midportion of each recovery pipe, normally biased downwardly and has an air passage communicating with said air supply source; and a second valve member slidably fitted on the lower end of each recovery pipe, spaced apard downwardly of said first valve member by a predetermined distance, having an air passage and adapted to be slidably moved upwardly by the opening of each of said containers when each of said containers is raised upward by the case supporting means with each recovery pipe inserted into each container, said air passage of said first valve member communicating with the air passage of the second valve member so that the compressed air from the air supply source is charged into the corresponding container when the first and second valve members abut against each other on each recovery pipe, each of said recovery pipes being liquid-tightly and slidably extended through the bottom plate of said recovery tank and being normally biased downwardly so that each recovery pipe can slide upwardly by a predetermined distance when the lower end of each recovery pipe strikes against the bottom of each container.

2. A device for recovering the contents in containers such as beer bottles according to claim 1, wherein said case supporting means is moved vertically by means of a hydraulically operated lifting means, said plurality of recovery pipes being suspended from the bottom plate of said recovery tank which is disposed above said case supporting means, said bottom plate being a part of said recovery tank.

3. A device for recovering the contents in containers such as beer bottles according to claim 1, wherein said recovery pipes equal in number to said containers in said case are arranged as a group, a plurality of groups of recovery pipes being provided, said case supporting means being provided with a free roller conveyor means so as to transport said cases over said case supporting means.

4. A device for recovering the contents in containers such as beer bottles according to claim 3, wherein said device has a reservoir communicated with said recovery tank via discharge pipes, said recovery tank being provided with an air drain pipe, said recovery tank being located higher than said second recovery tank so that the liquid charged into and stored in said recovery tank flows by gravity into said reservoir.

5. A device for recovering the contents of containers such as beer bottles according to claim 1, wherein said air supply source includes an air tank which is provided with a plurality of orifice-type air nozzles equal in number to said recovery pipes, said air nozzles being communicated through tubes or the like with said control valve means.

6. A device for recovering the contents in containers such as beer bottles according to claim 1, wherein said second valve member is in the form of a bell having an outwardly diverging skirt portion so that said second valve member can guide the opening of each of said containers in such a way that the top opening of said each container is aligned with the lower end of each recovery pipe.

7. A device for recovering the contents in containers such as beer bottles according to claim 1, wherein a tip means is attached to the lower end of each recovery pipe, the side wall of said tip means being formed with a cut-out portion or opening whereby when said tip means strikes against the bottom of each container, the content or liquid in each container can flow through said cut-out portion or opening into said each recovery pipe.

* * * * *